US009441622B2

(12) United States Patent
Liao

(10) Patent No.: US 9,441,622 B2
(45) Date of Patent: Sep. 13, 2016

(54) STRUCTURE OF TRIGGER-BOOSTING PULLING DEVICE

(71) Applicant: LIH YANN INDUSTRIAL CO., LTD., Taichung, Taiwan (TW)

(72) Inventor: Po Lin Liao, Taichung (TW)

(73) Assignee: LIH YANN INDUSTRIAL CO., LTD., Taichung (TW)

( * ) Notice: Subject to any disclaimer, the term of this patent is extended or adjusted under 35 U.S.C. 154(b) by 68 days.

(21) Appl. No.: 14/500,916

(22) Filed: Sep. 29, 2014

(65) Prior Publication Data

US 2016/0090977 A1 Mar. 31, 2016

(51) Int. Cl.
*F04B 37/14* (2006.01)
*F04B 33/00* (2006.01)
*B25B 11/00* (2006.01)

(52) U.S. Cl.
CPC ..... *F04B 37/14* (2013.01); *B25B 11/007* (2013.01); *F04B 33/00* (2013.01)

(58) Field of Classification Search
CPC ..... B21D 1/06
USPC ..... 269/21
See application file for complete search history.

(56) References Cited

U.S. PATENT DOCUMENTS 454,720 A * 6/1891 Dexter ..... A01M 3/005 15/344
2,049,872 A * 8/1936 Sera ..... B65B 31/04 141/65
2,280,658 A * 4/1942 Miller ..... B21D 43/18 15/409
2,771,933 A * 11/1956 Edwards ..... B21D 1/06 417/400
4,397,491 A * 8/1983 Anderson ..... B65G 7/12 294/131
4,565,506 A * 1/1986 Williams ..... F04B 37/10 417/440
5,727,418 A * 3/1998 Strozier ..... B21D 1/06 72/457
5,894,863 A * 4/1999 Lewis ..... F16L 55/134 137/223
6,213,521 B1 * 4/2001 Land ..... F16L 37/244 285/317
6,558,130 B1 * 5/2003 Chang ..... F04B 33/00 417/440
7,014,233 B2 * 3/2006 Chen ..... B25B 11/007 294/15
7,430,891 B1 * 10/2008 Wang ..... B21D 1/06 72/453.01
8,418,522 B1 * 4/2013 Liao ..... B21D 1/06 72/453.01
9,151,300 B2 * 10/2015 Cho ..... F04F 5/14
2006/0216171 A1 * 9/2006 Hernandez ..... A61M 1/0066 417/437

* cited by examiner

*Primary Examiner* — Joseph J Hail
*Assistant Examiner* — Tyrone V Hall, Jr.
(74) *Attorney, Agent, or Firm* — Andrew C. Cheng

(57) ABSTRACT

A trigger-boosting pulling device includes an elongate shank, which receives a backward ram to slidably fit thereon, a suction cup, which is fixed to a rear end of the elongate shank, a hand-operating pump structure, which is fixed to a front end of the elongate shank and includes a T-shaped pull grip that is connected by a connection bar to a piston assembly. The connection bar includes a spring fit thereon for position restoration of the pull grip. The pump cylinder includes a handle mounted thereto. The handle has a trigger that is arranged to drive, via a connection lever, the connection bar. As such, the T-shaped pull grip can be first pulled to induce a suction force to reach an initial level and then the handle is held by a hand and the trigger is pulled to drive the connection lever for doubling the force so as to induce enhanced vacuum suction force in the suction cup.

3 Claims, 8 Drawing Sheets

STRUCTURE OF TRIGGER-BOOSTING PULLING DEVICE

BACKGROUND OF THE INVENTION

1. Field of the Invention

The present invention relates to the field of pulling devices, and in particular to a structure of a trigger-boosting pulling device, which comprises a T-shaped pull grip for initial induction of vacuum suction force and a handle comprising a trigger that is operable to supply a force that is subjected to doubling to increase the vacuum suction force.

2. The Related Arts

FIG. 1 shows an exploded view of a hand-operated vacuum pulling device disclosed in U.S. Pat. No. 8,651,458, which is an early invention of the present inventor. The hand-operated vacuum pulling device comprises an elongate shank 70. The elongate shank 70 receives therein a tube 73. The elongate shank 70 receives a backward ram 71 to slidably fit thereto. The elongate shank 70 has a rear end to which a suction cup 72 is mounted. The elongate shank 70 has a front end to which a hand-operating pump holding section 80 that comprises a pressure relief seat 81. The pressure relief seat 81 comprises a relief button assembly 82 and a relief button 83. The pressure relief seat 81 has a bottom forming a ram stop section. The hand-operating pump holding section 80 has a free end to which a ring cover assembly 93 is mounted. The ring cover assembly 93 is made up of a fixed sleeve 931, a ring 932, and a fastening member 933. When a piston assembly 90 is driven to induce vacuum, the ring cover assembly 93 can be then operation to drive the piston assembly 90 to move backward, whereby through being repeated several times, the stiffness of a spring 91 inside the piston assembly 90 is enhanced to increase the vacuum suction force of the suction cup 20 so that, particularly for use with the backward ram, an effect hand-operating pulling effect can be achieved.

Although the early-invented hand-operated vacuum pulling device is effective to supply a vacuum suction force of 550 mbar, it is still insufficient to some extents in practical applications. Further, a pull stem 92 is pressed in a very effort consuming manner to compress the spring 91 arranged therein in order to allow the back springing of the spring 91 to induce vacuum. To obtain a strong vacuum suction force, the spring 91 must be selected and a thick and powerful spring 91 must be used. This, however, requires additional effort to compress the spring 91. The compression is difficult and additional physical strength is needed. This is a drawback to be improved.

Further, in the early-invented hand-operating vacuum pulling device, the backward ram 71 is of a unitary design and such a unitary design would lead to a great waste of material in the manufacturing thereof and the manufacturing is difficult, leading to an increased cost. Improvement is also needed in this respect.

Thus, in view of the drawbacks of the known device, it is desired to provide a solution that overcomes the drawbacks.

SUMMARY OF THE INVENTION

An object of the present invention is to provide a trigger-boosting pulling device, which comprises a T-shaped pull grip for inducting a suction force of an initial level and a handle having a trigger that is operable to supply a force that is doubled to increase the vacuum suction force.

To achieve the above object, the present invention provides a trigger-boosting pulling device, which comprises: an elongate shank, which comprises a backward ram slidably fit thereto, a suction cup, which is fixed to a rear end of the elongate shank, and a hand-operating pump structure, which is fixed to a front end of the elongate shank. The hand-operating pump structure comprises a T-shaped pull grip that is connected by a connection bar to a piston assembly. The connection bar comprises a spring fit thereto for position restoration of the pull grip. A handle is coupled to the outside of a pump cylinder and the handle comprises a trigger that drives, via a connection lever, the connection bar. As such, the T-shaped pull grip can be first pulled to induce a suction force to reach an initial level and then the handle is held by a hand and the trigger is pulled to drive the connection lever for doubling the force so as to induce enhanced vacuum suction force in the suction cup.

To achieve the above object, the present invention provides a trigger-boosting pulling device, which comprises a backward ram that is made of components that are manufactured separately to effectively reduce the cost and then assembled together.

To achieve the above object, the present invention provides a trigger-boosting pulling device, which comprises an elongate shank and a hand-operating pump structure between which a pressure relief seat is mounted. The pressure relief seat comprises an inner thread. A relief knob comprising an external thread is engageable with the inner thread of the pressure relief seat. The pressure relief seat has a circumference in which an aperture is formed and extends into the pressure relief seat, whereby tightening the relief knob makes the aperture blocked and not allowing for relief of vacuum and to release the vacuum, the relief knob is rotated open to allow air to flow through the aperture into the suction cup to release the vacuum.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

The present invention provides a design of a structure of a trigger-boosting pulling device.

For better understanding the objects, features, and effects of the present invention, a detailed description of an embodiment will be given with reference to the attached drawings.

Figure 1:
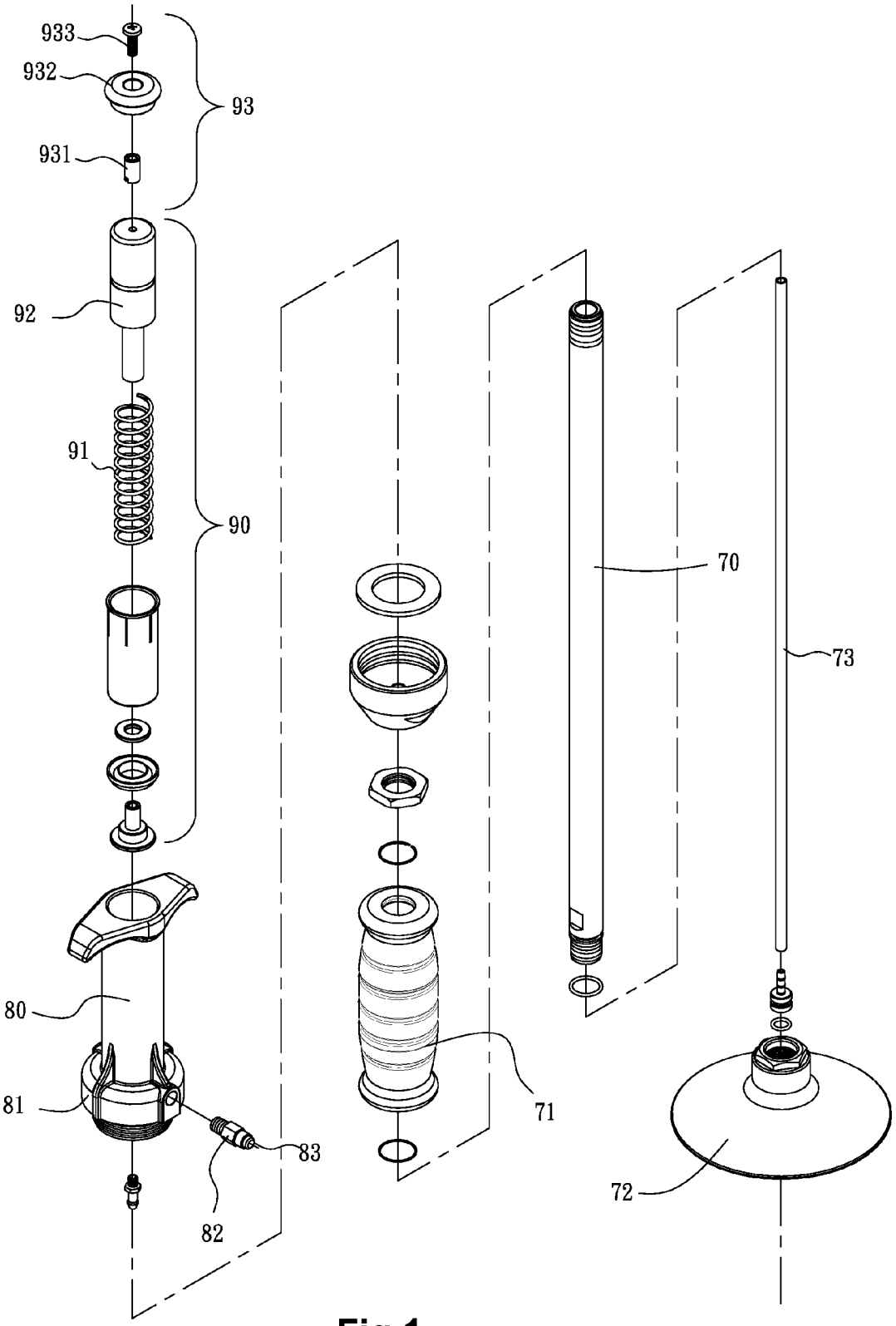
Fig 1 Prior Art
FIG. 1 is an exploded view of a conventional hand-operating vacuum pulling device.
Figure 2:
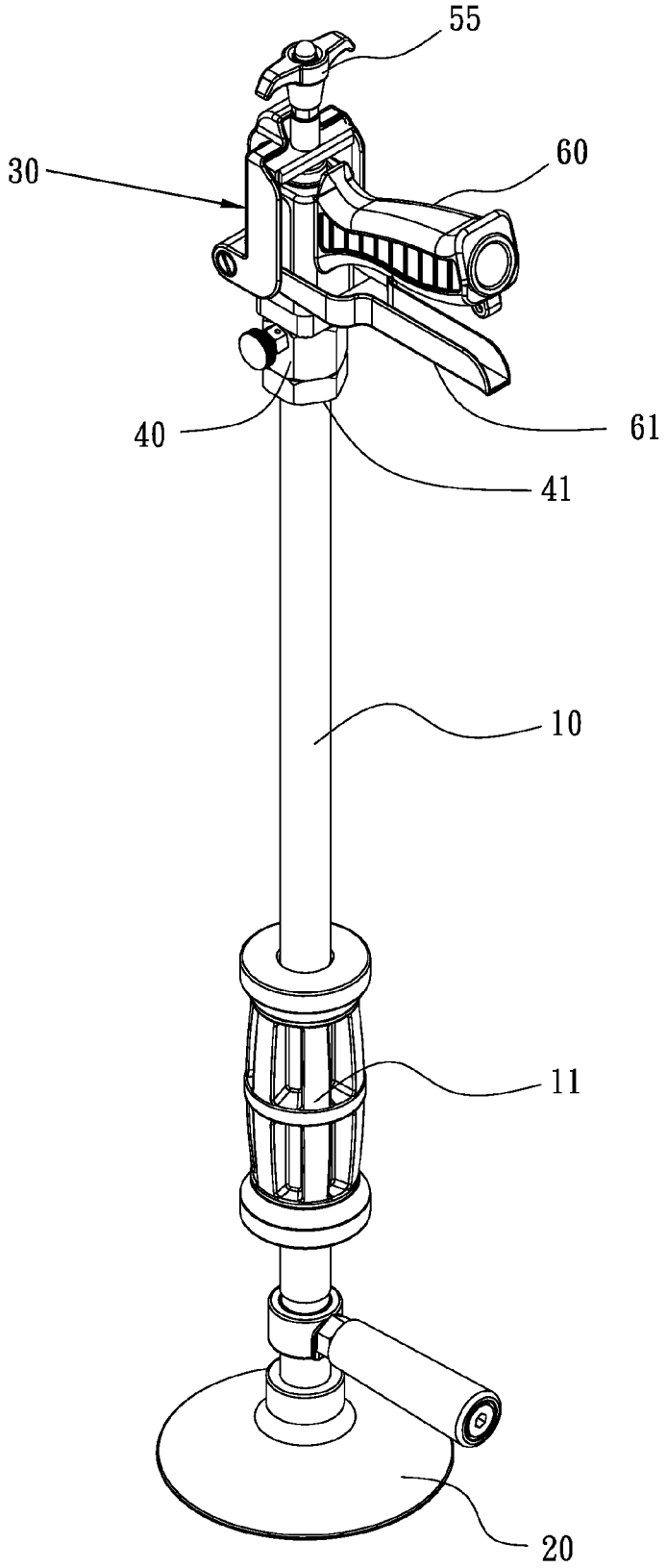
FIG. 2 is a perspective view showing an embodiment of the present invention.
Figure 3:
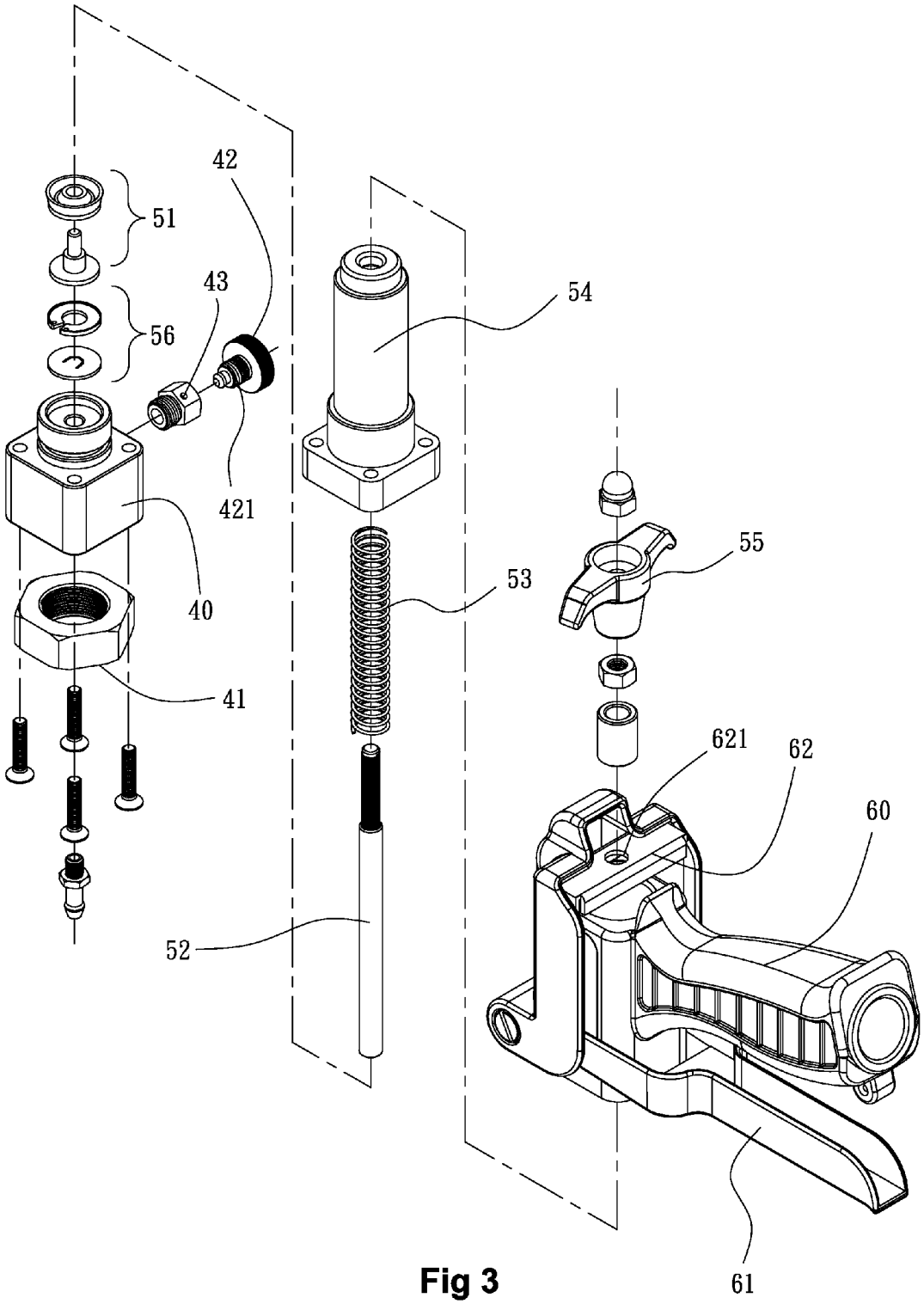
FIG. 3 is an exploded view showing the embodiment of the present invention.
Figure 4:
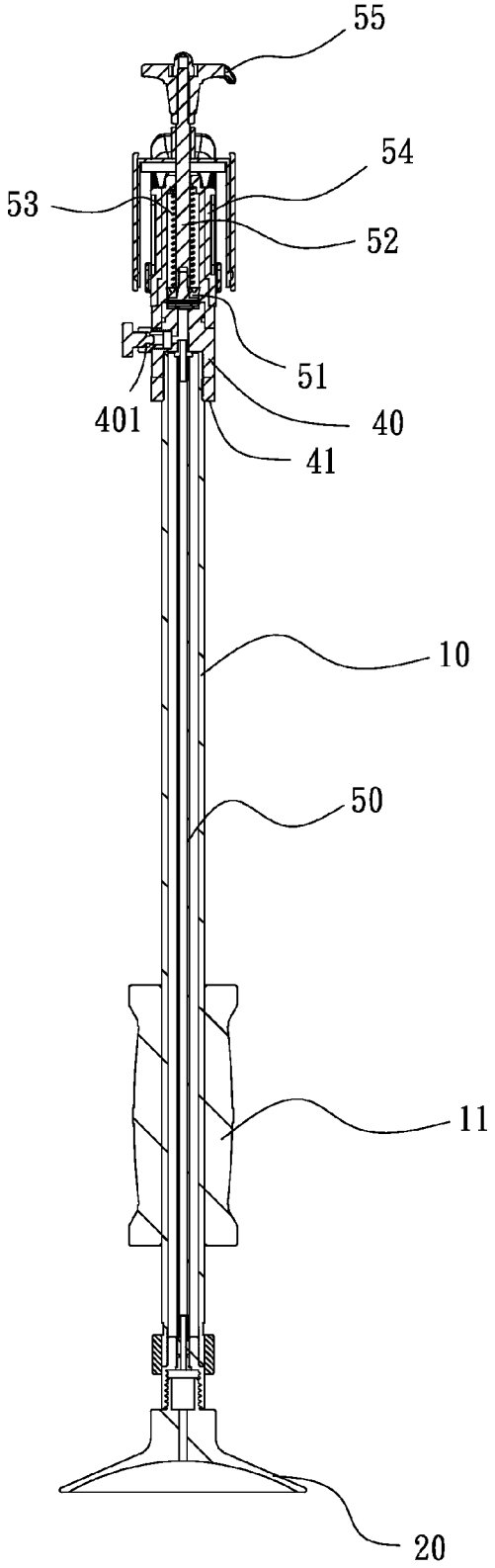
FIG. 4 is a cross-sectional view showing the embodiment of the present invention.

Referring to FIGS. 2-4, the present invention provides a structure of a trigger-boosting pulling device, which comprises:

an elongate shank 10, the elongate shank 10 receiving a backward ram 11 slidably fit thereon;

a suction cup 20, the suction cup 20 being fixed to a rear end of the elongate shank 10;

a hand-operating pump structure 30, the hand-operating pump structure 30 being fixed to a front end of the elongate shank 10;

a pressure relief seat 40, the pressure relief seat 40 being mounted between the elongate shank 10 and the hand-operating pump structure 30, the pressure relief seat 40 having a bottom forming a ram stop section 41; and a tube 50, the tube 50 being received in the elongate shank 10, the tube 50 communicating with the pressure relief seat 40 and the suction cup 20, wherein the hand-operating pump structure 30 comprises a check valve 56 and a piston assembly 51 arranged thereon, the check valve 56 and the piston assembly 51 being mounted to an end of a connection bar 52, the connection bar 52 comprising a spring 53 fit thereon, the connection bar 52 being arranged to extend through a pump cylinder 54, the connection bar 52 having a front end to which a T-shaped pull grip 55 is attached, the pump cylinder 54 having an outer circumference to which a handle 60 is attached, the handle 60 comprising a trigger 61 pivotally attached thereto, the trigger 61 being connected to a connection lever 62, the connection lever 62 having a free end in which a through hole 621 is formed, the through hole 621 receiving the connection bar 52 to extend therethrough, whereby repeatedly pulling the T-shaped pull grip 55 induces a vacuum suction force in the suction cup 20 that achieves a basic vacuum suction force of around 550 mbar and, subsequently, repeatedly pulling the trigger 61, which is subjected to force doubling by the connection lever 62 and supplied to pull the piston assembly 51 to increase the vacuum suction force of the suction cup 20 to a predetermined level of enhanced vacuum suction force of around 700 mbar.

The trigger-boosting pulling device is structured in such a way that components that make up the backward ram 11 can be manufactured separately so that the cost can be greatly reduced and then the separate components can be assembled together to form the backward ram 11.

The trigger-boosting pulling device is structured in such a way that the pressure relief seat 40 comprises an inner thread 401 and a relief knob 42 that comprises an external thread 421 is threadingly engageable with the inner thread 401 of the pressure relief seat 40. The pressure relief seat 40 has a circumference in which an aperture 43 is formed and extends into the pressure relief seat 40, whereby tightening the relief knob 42 makes the aperture 43 blocked and not allowing for relief of vacuum. To release the vacuum, the relief knob 42 is rotated open to allow air to flow through the aperture 43 into the suction cup 20 to release the vacuum.

Figure 5:
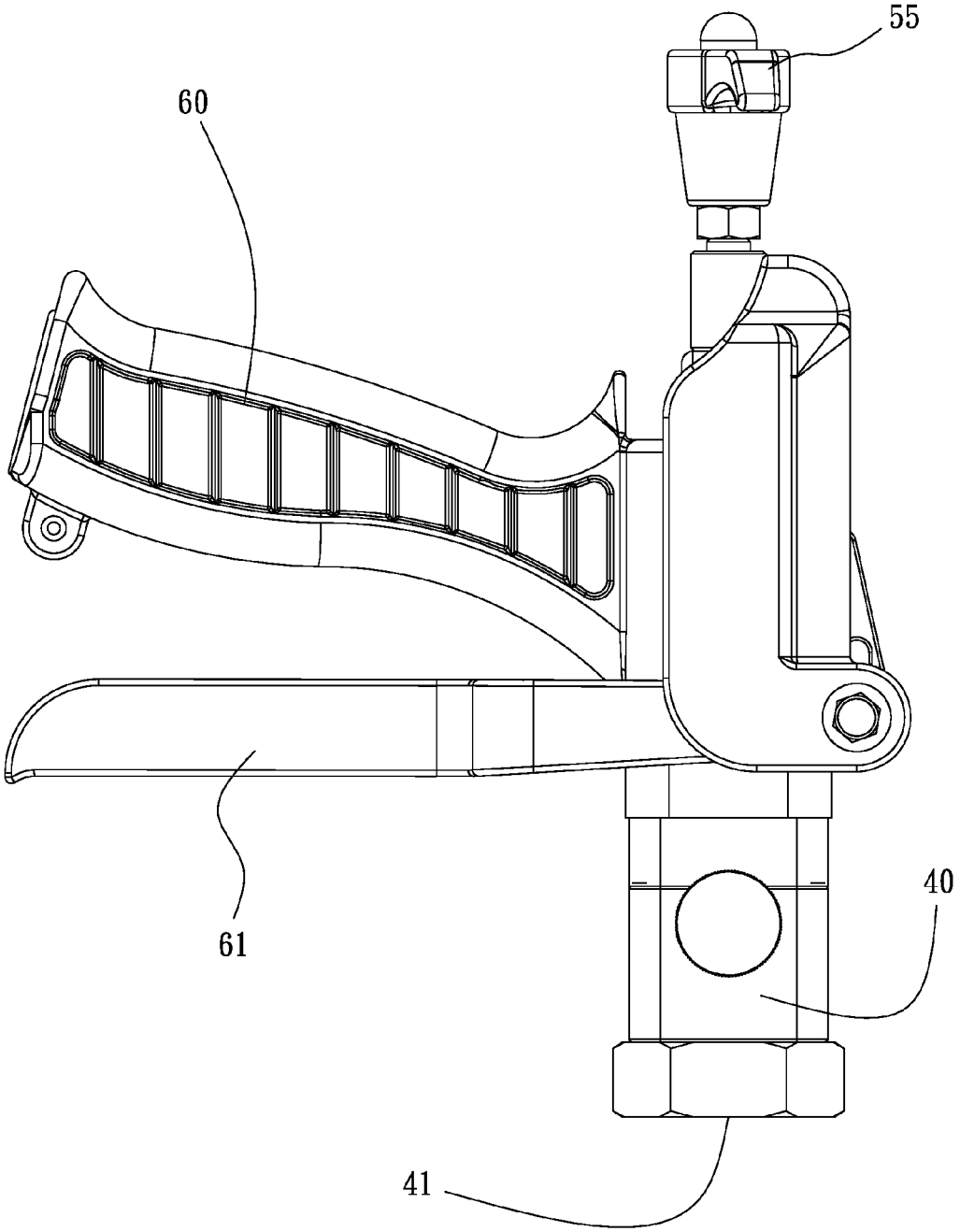
FIG. 5 is a side elevational view showing a hand-operating pumping structure according to the embodiment of the present invention.
Figure 6:
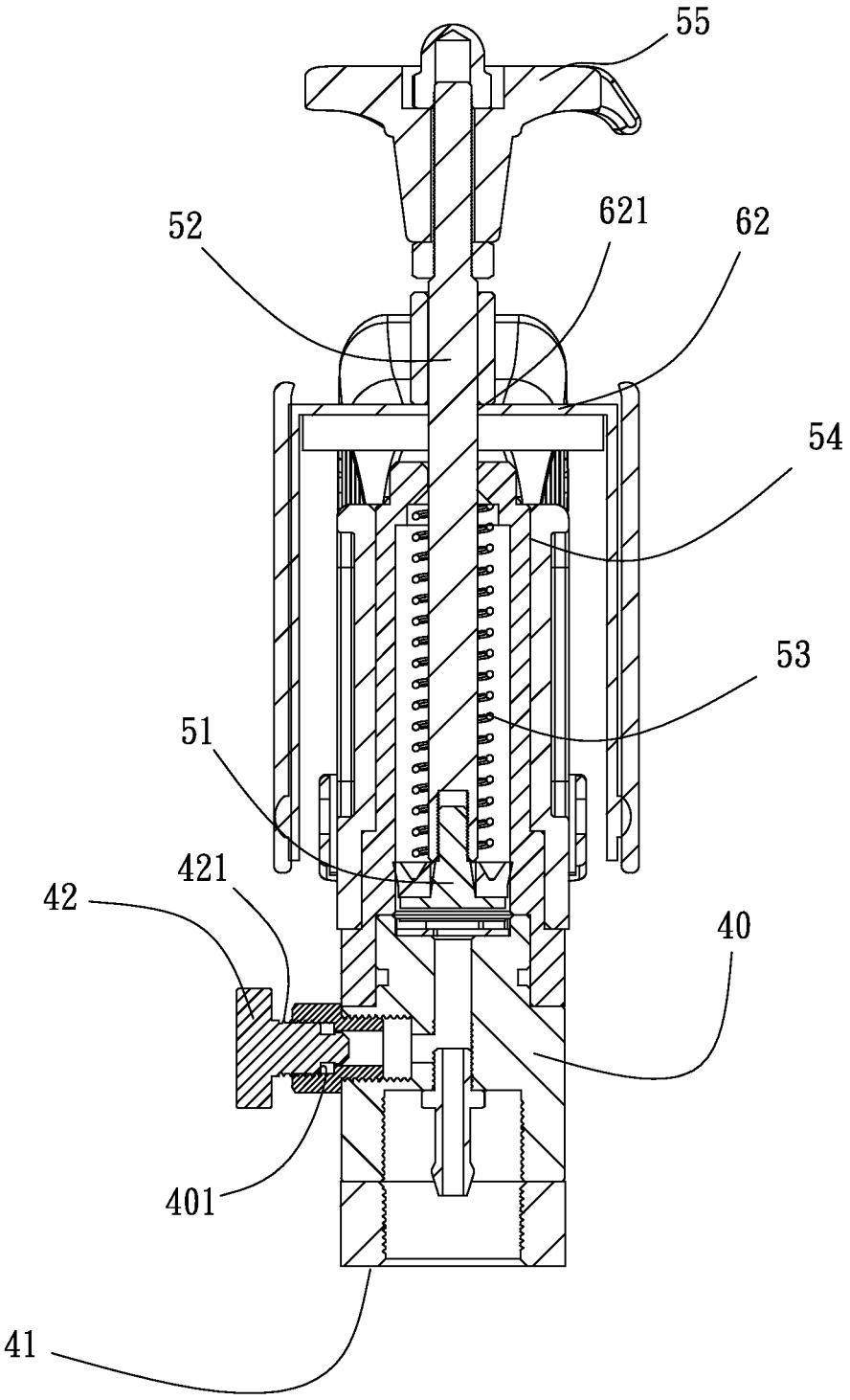
FIG. 6 is a cross-sectional view showing the hand-operating pumping structure according to the embodiment of the present invention.

Referring to FIGS. 5 and 6, the T-shaped pull grip 55 of the hand-operating pump structure 30, when operated, pulls the piston assembly 51 so that vacuum is allowed to transmit from a front end of the piston assembly 51 through the tube 50 to reach the suction cup 20. The spring 53 functions for position restoration of the connection bar 52 and there is no need for strengthening. Vacuuming is achieved by means of reciprocally pulling the piston assembly 51 through repeatedly pulling the T-shaped pull grip 55 in order to reach a vacuum suction force of 550 mbar, and under this condition suction force boosting can be performed by hand holding the handle 60 with fingers gripping and pulling the trigger 61 to perform alternate holding and releasing operations. Such operations drive the connection lever 62 to pull the connection bar 52 in an leverage based effort-saving manner in order to have the vacuum suction force reaching 700 mbar, whereby the vacuum suction force may achieve a desired level of suction force.

Figure 7:
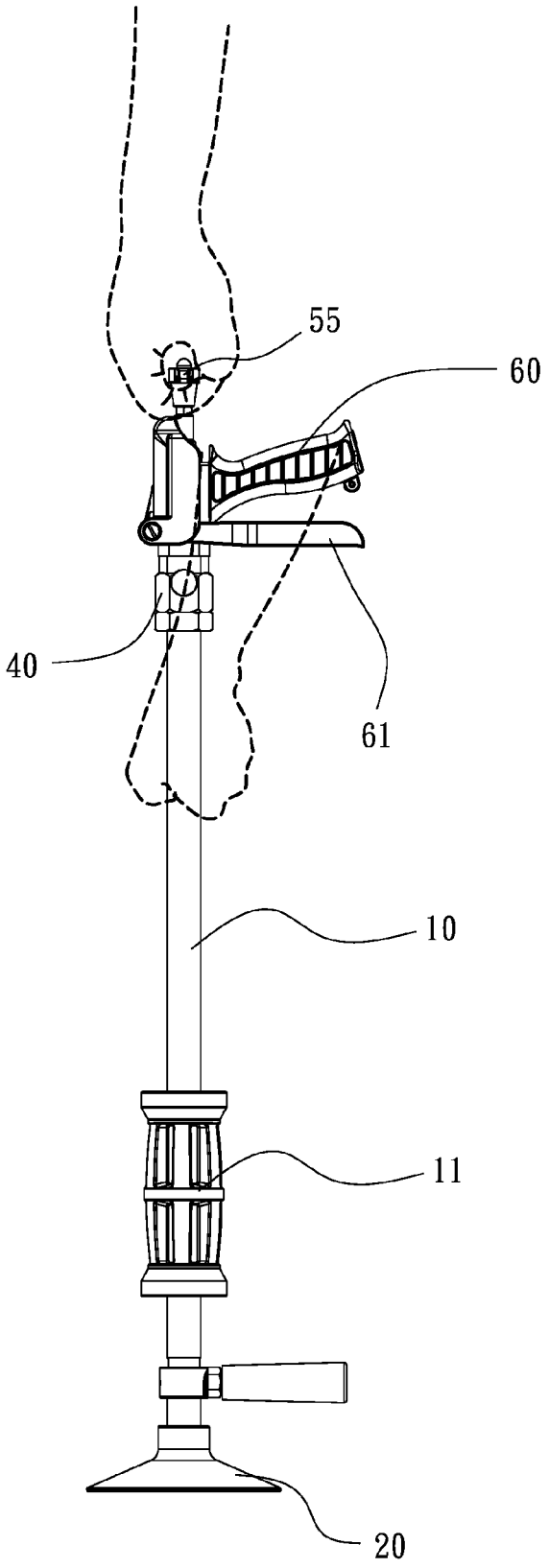
FIG. 7 is a schematic view illustrating an operation of pulling to induce a suction force.

Referring to FIG. 7, an operation of hand pulling the T-shaped pull grip to continuously drive the piston assembly 51 to achieve a vacuum suction force of 550 mbar.

Figure 8:
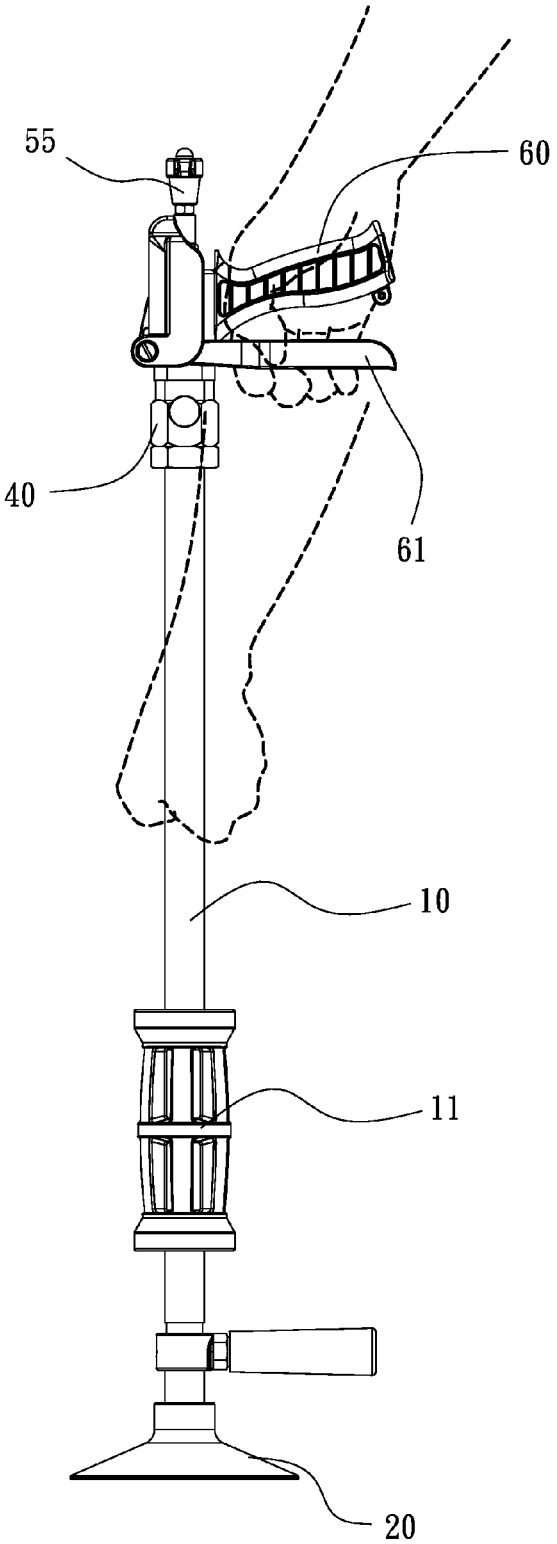
FIG. 8 is a schematic view illustrating an operation of pulling a trigger to induce enhanced suction force.

As shown in FIG. 8, when the vacuum suction force achieves 550 mbar, suction force boosting is performed, where a hand of a user holds the handle 60 with fingers gripping the trigger 61 to perform alternate holding and releasing operations. Such operations drive the connection lever 62 to pull the connection bar 52 in an leverage based effort-saving manner in order to have the vacuum suction force reaching 700 mbar, whereby the vacuum suction force may achieve a desired level of suction force.

To this point, it is understood that the present invention provides a trigger-boosting pulling device, which comprises a T-shaped pull grip that is operable by being pulled by a user to induce a basic vacuum suction force and a hand comprising a trigger that is subsequently operable to boost the vacuum suction force.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A trigger-boosting pulling device, comprising:

an elongate shank, which receives a backward ram to slidably fit thereto; a suction cup, which is fixed to a rear end of the elongate shank; a hand-operating pump structure, which is attached to a front end of the elongate shank and opposite to the suction cup in a predetermined direction; a pressure relief seat, which is mounted between the elongate shank and the hand-operating pump structure to attach the hand-operating pump structure to the front end of the elongate shank and comprising a passage defined therethrough, the pressure relief seat having a bottom forming a ram stop section; and a tube, which is received in a hollow interior of the elongate shank and in communication with the passage of the pressure relief seat and the suction cup, wherein the hand-operating pump structure comprises a check valve and a piston assembly arranged thereon, the piston assembly being mounted to a rear end of a connection bar, the connection bar being arranged to extend through a pump cylinder in the predetermined direction such that the rear end of the connection bar to which the piston assembly is mounted is close to the suction cup, the connection bar having a front end which is opposite to the rear end and extends through and outside a distal end of the pump cylinder to receive a T-shaped pull grip fixed thereto, a spring being received in the pump cylinder and having an end supported on the piston assembly and an opposite end fixed to the distal end of the pump cylinder so as to bias the piston assembly toward a proximal end of the pump cylinder that is opposite to the distal end and close to the suction cup, the proximal end of the pump cylinder being connected to and in communication with the passage of the pressure relief seat so as to be in communication with the tube and the suction cup, the pump cylinder having an outer circumference to which a handle is attached, the handle comprising a trigger pivotally attached thereto, the trigger being connected to a connection lever, the connection lever having a free end in which a through hole is formed, the through hole receiving the connection bar to extend therethrough, wherein the T-shaped pull grip is operable to drive the piston assembly to move, in a first direction, from an inner position where the piston assembly is close to the proximal end of the pump cylinder to an outer position where the piston assembly is close to the distal end of the pump cylinder and to further move, in an opposite second direction, from the outer position back to the inner position so as to induce vacuum of a first pressure level in the suction cup that achieves a basic vacuum suction force and the trigger is subsequently operable to cause the connection lever to drive the piston assembly to move from the first position to the second position and further move from the second position back to the first position to change the vacuum the suction cup the first pressure level to a second pressure level that is lower than the first pressure level and provides an enhanced vacuum suction force;

wherein the spring provides a biasing force that biases the piston assembly toward the proximal end of the pump cylinder so as to be consistent with and assist the movement of the piston assembly from the position end to the inner position to allow for the operation of the trigger to move the piston assembly from the inner position to the outer position to change the vacuum of the suction cup from the first pressure level to the second pressure level.

2. The trigger-boosting pulling device as claimed in claim 1, wherein the backward ram is made up of components that are manufactured separately and then assembled together.

3. The trigger-boosting pulling device as claimed in claim 1, wherein the pressure relief seat comprises an inner thread, a relief knob comprising an external thread and engageable with the inner thread of the pressure relief seat, the pressure relief seat having a circumference in which an aperture is formed and extends into the pressure relief seat to communicate with the passage of the pressure relief valve, whereby tightening the relief knob makes the aperture blocked and not allowing for relief of vacuum and to release the vacuum, the relief knob is rotated open to allow air to flow through the aperture into the suction cup to release the vacuum.

* * * * *